United States Patent [19]

Paoletti

[11] Patent Number: 4,559,983

[45] Date of Patent: Dec. 24, 1985

[54] DEVICE FOR PREPARING AND DISPENSING A SOLUTION

[75] Inventor: Jean-Claude Paoletti, Volvic, France

[73] Assignee: Laboratoires Merck Sharp & Dohme Chibret, Paris, France

[21] Appl. No.: 563,727

[22] Filed: Dec. 21, 1983

[30] Foreign Application Priority Data

Dec. 29, 1982 [FR] France ..... 82 21991

[51] Int. Cl.[4] ..... B65B 3/04; B67C 3/26

[52] U.S. Cl. ..... 141/260; 141/366; 206/219; 222/209; 366/130; 604/91; 604/414

[58] Field of Search ..... 222/80, 83, 129, 145, 222/386, 478, 481, 510, 524, 525, 527, 528, 539, 209, 211, 212, 401; 604/82, 88, 89, 91, 203, 204, 231, 411, 413–415; 366/130, 150; 141/3, 20, 100, 104, 260, 329, 364–366; 206/219, 221, 222; 215/DIG. 3, DIG. 8, 6

[56] References Cited

U.S. PATENT DOCUMENTS

| | | | |
|---|---|---|---|
| 2,342,215 | 2/1944 | Perelson | 222/83 X |
| 2,541,272 | 2/1951 | Murphy | 141/329 |
| 2,570,955 | 10/1951 | Keeshan | 222/481 |
| 2,798,488 | 7/1957 | Hall | 604/82 |
| 2,957,609 | 10/1960 | Holmes | 222/212 |
| 3,044,500 | 7/1962 | Crisafi | 141/366 X |
| 3,125,092 | 3/1964 | Cohen | 222/209 X |
| 3,206,073 | 9/1965 | Scislowicz | 222/80 |
| 3,491,916 | 1/1970 | Graham | 222/80 |
| 3,608,550 | 9/1971 | Stawaki | 604/414 |
| 3,917,063 | 11/1975 | Chibret | 222/83 X |
| 4,191,225 | 3/1980 | Ogle | 604/414 X |

FOREIGN PATENT DOCUMENTS

| | | | |
|---|---|---|---|
| 558613 | 7/1957 | Belgium . | |
| 1167766 | 11/1958 | France | 604/82 |
| 1342288 | 9/1963 | France . | |
| 1522890 | 8/1978 | United Kingdom . | |

*Primary Examiner*—Joseph J. Rolla
*Assistant Examiner*—Kevin P. Shaver
*Attorney, Agent, or Firm*—William H. Nicholson; Mario A. Monaco

[57] ABSTRACT

The invention relates to a device for preparing and dispensing a solution. A bottle containing a substance to be disolved is closed by a disc-shaped base having a rigid rod thereon and a deformable head. A tube of solvent is closed by an apertured slidable piston. Mixing is effected by placing the piston against the rigid rod and applying axial pressure which dispenses the solvent from the tube, through a capillary channel in the rod and into the bottle. Slots in the rod are revealed during this operation to allow the air to escape from the bottle. The deformable head also serves to pressurize the bottle to permit dispensing therefrom.

1 Claim, 9 Drawing Figures

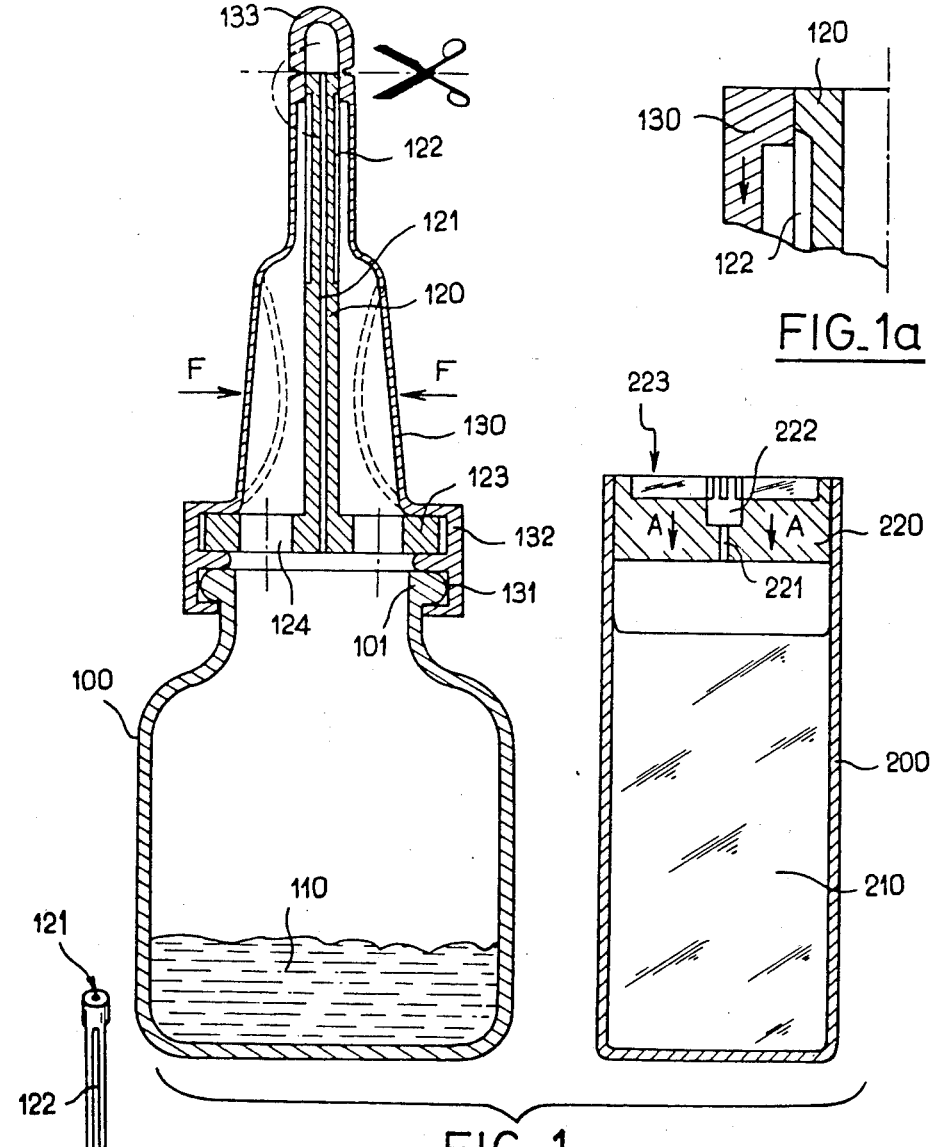
FIG. 1
FIG. 1a
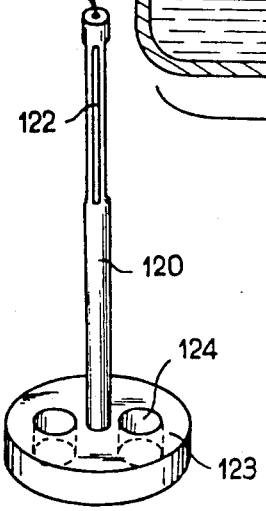
FIG. 2
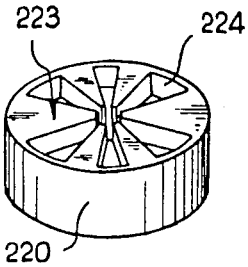
FIG. 3a
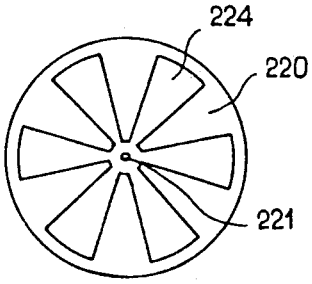
FIG. 3b

DEVICE FOR PREPARING AND DISPENSING A SOLUTION

The present invention relates to a device for preparing and dispensing a solution.

Such a device is generally available to the consumer in extemporaneous form, i.e. the solution is to be prepared at the moment of use.

A first bottle contains the solvent and a second bottle contains the substance to be dissolved, for example in lyophilized form. This second bottle may generally be converted into a bottle for instillation, for example by adapting a dropper teat on its neck.

To prepare the solution, the user unstoppers the two bottles, pours the solvent into the second bottle containing the substance to be dissolved, and stoppers the latter with the teat.

This manipulation is not always easy, as the bottles are often small; a certain skill is required and there is always a risk of spilling part of the solvent when the user pours it into the second bottle and when he places the teat in position.

In addition, as the two bottles must be unstoppered, there are also risks of soiling by the user's fingers during preparation or positioning of the teat.

It is therefore impossible to guarantee that the preparation, made in this manner, is perfectly sterile.

One of the objects of the invention is to remedy these drawbacks by proposing a device allowing sterile preparation of the solute; the device according to the invention does not, in fact, necessitate any unstoppering of the recipients. Furthermore, the dispensing means—for example the instilling head—are already adapted to the bottle, this rendering it adapted to dispense the solution as soon as preparation has been effected, without any additional manipulation.

To this end, the device according to the invention comprises:

- a bottle containing a solid substance, this bottle being adapted to receive a solvent of this substance and to contain the solution obtained;
- a stopper for this bottle, provided with a rigid tube traversed by an axially extending capillary channel allowing introduction of the solvent and dispensing of the solution;
- a tube containing the solvent;
- a piston obturating this tube and adapted to penetrate therein, hermetically adaptable to the rod of the stopper of the bottle, and traversed by a conduit for expelling the solvent, so that the application of the piston on the rod places the conduit of the piston and the channel of the rod in communication and the fact of driving the piston in the tube brings about delivery of the solvent from the tube towards the bottle.

In a first embodiment, the rigid rod is covered by an elastically deformable instilling head, hermetically adapted to the rod, this instilling head being capable, under the effect of an axial crushing exerted by the application of the piston on the rod, of a first deformatiion revealing at least one air passage made in the rod, and ensuring escape of air from the atmosphere in the bottle towards the outer atmosphere, this instilling head also being capable, under the effect of a radial crushing, of a second deformation allowing instillation of the solution via the capillary channel in the rod due to the increase in pressure exerted in the atmosphere in the bottle, the passage of air then remaining obturated.

In a second embodiment, the rigid rod may be driven inside the stopper of the bottle, communication of the capillary channel of the rod with the inner volume of the bottle being ensured by this driving-in and being prevented in the contrary case, the stopper being fixed to the bottle in sufficiently tight manner for the atmosphere in said bottle to be maintained under pressure.

In this second embodiment, a further advantage is the fact that the solution is contained in a recipient under pressure, therefore is easy to dispense in the form of aerosol or the like.

The invention will be more readily understood on reading the following description with reference to the accompanying drawings, in which:

FIG. 1 is a vertical section through the two elements, bottle and tube, of the first embodiment according to the invention.

FIG. 1*a* is a detail of the top part of this bottle, marked by a semi-circle in dashed and dotted lines in FIG. 1.

FIG. 2 is a perspective view of the rigid rod of the bottle of FIG. 1.

FIGS. 3*a* and 3*b* are perspective and plan views of the piston of the tube of FIG. 1.

FIG. 4 explains the manner in which the tube and the bottle cooperate at the moment of filling.

Figure 4:
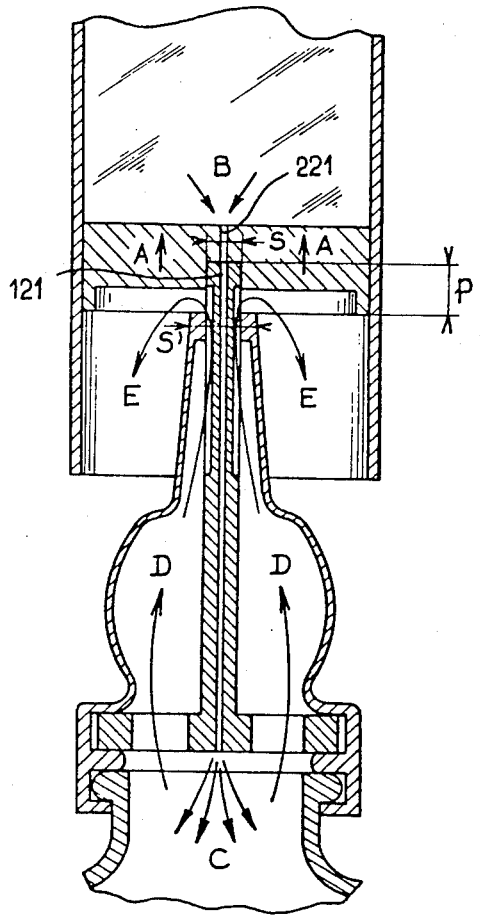

Referring now to the drawings, FIGS. 1 to 4 show the first embodiment: the device according to the invention is composed of a bottle 100 containing a substance 110 to be dissolved, for example a lyophilisate, and of a tube 200 containing a solvent 210 of the substance 110; the solution obtained by dissolution of the substance will be contained in the bottle 100.

The bottle 100 is closed by a stopper composed of a rigid rod 120 (shown by itself in FIG. 2) covered by an elastically deformable instilling head 130. This instilling head is hermetically adapted to the top part of the rod (FIG. 1*a* shows the rod 120 and the head 130 applied against each other, when the head is not deformed). At its base, the head comprises two circular inner grooves 131 and 132; the first of these grooves is adapted on the neck 101 of the bottle 100 and the second on the disc-shaped base 123 of the rod. This arrangement ensures correct centering of the bottle-rod-head assembly.

The upper end of the head 130 may advantageously be hermetically closed by an appendix 133 which the user must cut to the level of the end of the rod 120, at the moment of use.

A capillary channel 121 passes right through the rod 120, this channel ensuring communication of the contents of the bottle with the outside, both, as will be seen hereinafter, for filling the bottle with the solvent and for dispensing the solution. Finally, the top part of the rod 120 comprises longitudinal slots 122 forming air passages, as well as orifices 124 for communication, made in the disc-shaped base 123.

For its part, the tube 200 is closed by a piston 220 (also shown in perspective and in plan view in FIGS. 3*a* and 3*b* respectively), which may be driven inside the tube (arrows A). A conduit 221 for expelling the solvent passes through this piston, so that the fact of the piston penetrating in the tube causes the solvent to be discharged to outside the tube.

This piston is hermetically adaptable to the rod 120 of the bottle stopper, due in particular to a central housing 222 which covers the end of the rod (position shown in FIG. 4); the conduit 221 for expelling the solvent and the capillary channel 121 of the rod are then in line with each other.

The piston presents an upper face 223 forming support face for the axial crushing of the instilling head 130; to this end, the second S of the housing 222 is smaller than the section S' of the top part of the instilling head (FIG. 4). It will also be seen that the depth p of the housing is at least equal to the depth of penetration necessary for the crushed instilling head to reveal the slots in the rod and to allow the passage of air. These slots are placed in communication with the outside atmosphere via radial recesses 224 made on the top face of the piston.

The solution is prepared as follows: the user cuts the end piece 133 level with the top end of the rod. He takes the tube containing the solvent, turns it upside down and applies the piston in abutment on the rod of the bottle, in the position shown in FIG. 4. By pressing on the tube, he causes the slots 122 to be disengaged and brought into communication with the outside atmosphere via the radial recesses, due to a first deformation of the instilling head, under the effect of the axial crushing exerted by the application of the piston. The amplitude of this first deformation is determined by the depth p of the housing 222 made in the piston.

Once the rod has come into abutment against the bottom of the housing of the piston, the user continues to apply downward pressure on the tube, which will cause the piston to penetrate and the liquid to discharge (arrow B) through the expulsion conduit 221 then through the capillary channel 121 of the rod, up to the interior of the bottle (arrow C), thus allowing dissolution of the substance to be dissolved.

During decanting, the air imprisoned in the bottle may escape, by passing through the orifices 124 made in the base of the rod (arrows D), then through the slots 122 of the rod and the radial receses 224 of the piston (arrows E).

Decanting thus being effected, the user withdraws the tube and its piston, and the instilling head takes back its initial shape by elasticity, in the position shown in FIG. 1 (but the bottle is now filled with solution). The slots 122 are then obturated.

The solution is dispensed by exerting a radial crushing (arrows F) on the instilling head, which performs a role similar to that of a conventional teat. This radial crushing produces a deformation (shown in dashed lines in FIG. 1) of the lower part of the head 130, but not of its top part: in this way, the slots 122 permanently remain obturated; the solution cannot flow therethrough and this second deformation produces an increase in pressure in the atmosphere of the bottle, which allows the solution to be expelled through the capillary channel 121.

Figure 5:
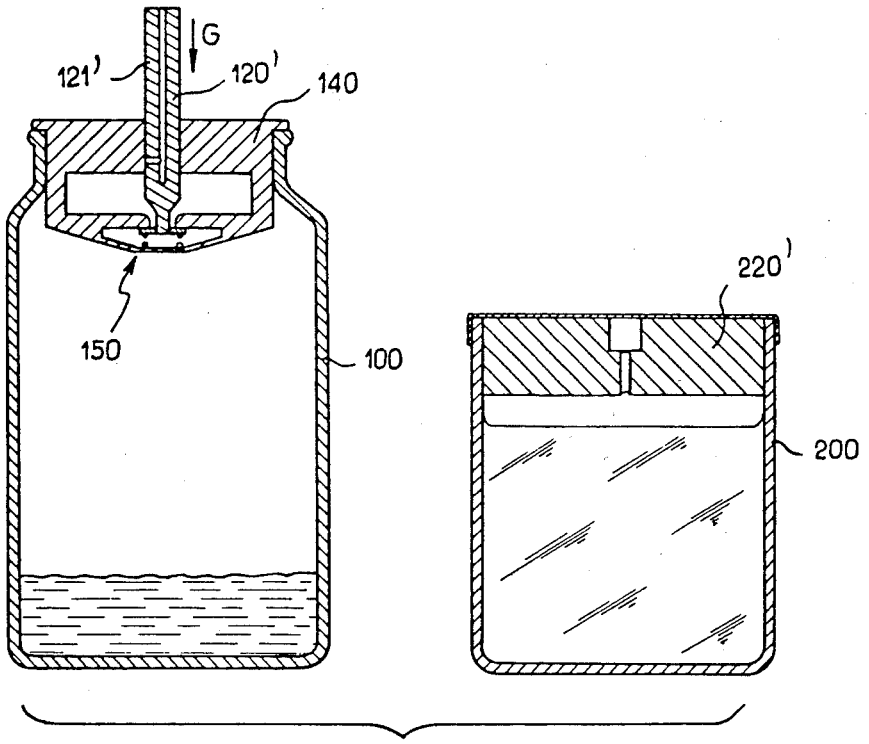
FIG. 5 is homologous to FIG. 1, for the second embodiment of the device according to the invention.
Figure 6:
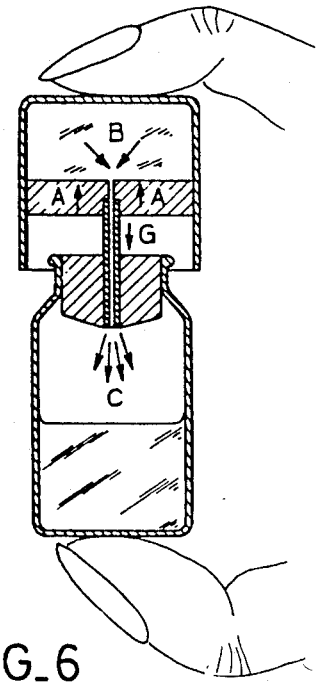
FIG. 6 is likewise the homologue of FIG. 4.
Figure 7:
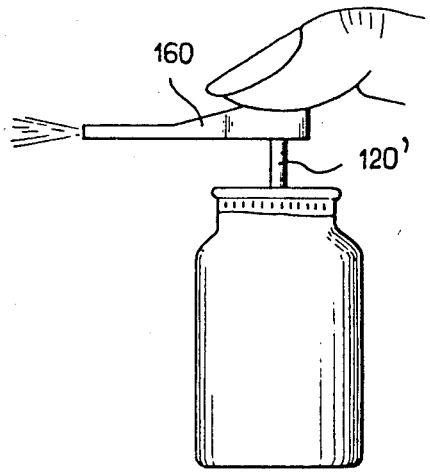
FIG. 7 shows the bottle of the second embodiment ready for use.

FIGS. 5 to 7 refer to a second embodiment of the invention, comparable to the preceding one, but comprising no air passages: on the contrary, it is desired to maintain the gas imprisoned in the bottle and compressed at the moment of decanting, under pressure.

In this second embodiment, the bottle 100 is closed by a stopper 140 forming dosing valve. This stopper, which is of known type wide-spread in the domain of aerosols, has only been shown schematically in FIG. 5; it comprises a rod 120' traversed by a capillary channel 121'; this capillary channel may be placed in communication with the interior of the bottle by a movement of penetration of the rod (arrow G) which opens, in known manner, a closure valve 150.

Differing from the first embodiment, the capillary channel is therefore not in permanent communication with the interior of the bottle. In addition, the rod 120' does not comprise any slot for passage of air. This arrangement makes it possible to maintain the internal atmosphere of the bottle 100 under pressure.

The tube 200 containing the solvent is similar to that of the first embodiment; the only difference is that the piston 220' which obturates it comprises no radial recess for passage of air.

The manner in which the mixture is effected is shown in FIG. 6: The vertical downward pressure which the user exerts firstly provokes penetration of the rod (arrow G) and therefore communication of the capillary channel with the interior of the bottle; it then provokes penetration of the piston and decanting of the solvent to the interior of the bottle (arrows A, B, C) in the same manner as before.

Differing from the first embodiment, any escape of gas is prevented, and the atmosphere in the bottle remains under pressure.

The final pressure in the bottle is a function of the volume of solvent transferred with respect to the total volume of the bottle.

The solution is dispensed (FIG. 7) by means of an end piece 160 adapted to the rod 120' of the dosing valve. This end piece allows the solution to be atomized in the form of aerosol, in known manner.

The two embodiments described have, of course, only been given by way of example and the invention extends to any variant within the spirit thereof.

What is claimed is:

1. A device for preparing and dispensing a solution which comprises:

a bottle containing a solid substance, the bottle having an opening and being adapted to receive a solvent for the solid substance and to contain the solution resulting from dissolution of the solid substance;

a closure for the bottle opening comprising a rigid tube mounted on a disc shaped base exteriorly of the bottle opening, said tube and base having an axial capillary channel extending from the top of the tube to the bottom of the disc shaped base, and longitudinal slots on the surface of the tube starting near the top of the rigid tube, the disc shaped base having orifices extending therethrough;

an elastically deformable, essentially tubular instilling head, one end of which hermetically seals the disk shaped base to the mouth of the bottle, and the other end of which is hermetically in contact with the upper end of the tube so that the opening of the axial capillary channel is not covered but the longitudinal slots are enclosed within the instilling head, and said other end of the distilling head being slidable downwardly on said tube;

a second tube containing the solvent with an obturating piston inwardly slidable with respect to said second tube, the piston having an upper face with a depression therein, the depression having a cross-section the shape and size of the rigid tube and connected with recesses in the upper face extending radially from the depression towards but not to the periphery of the piston and an orifice extending from the bottom of the depression to the bottom of the obturating piston;

whereby insertion of the upper end of the rigid tube connected to the bottle into the depression of the obturating piston of the second tube causes an axial sliding of the instilling head on the rigid tube exposing the longitudinal slots in the rigid rod to the radially extending recesses in the obturating piston causing solvent to flow from the second tube through the orifice in the piston, down the axial capillary channel of the rigid tube and into the bottle thereby forming a solution of the solid substance and expelling an equal volume of air from the bottle through the orifices in the disc shaped base on which the tube is mounted, to the longitudinal slots in the rigid tube, to the radially extending recesses in the obturating piston to the atmosphere;

whereby, after separation of the rigid tube from the obturating piston of the second tube, the solution can be dispensed by radial crushing of the instilling head on the bottle.

* * * * *